United States Patent [19]

Becker

[11] Patent Number: 5,076,164

[45] Date of Patent: Dec. 31, 1991

[54] SHEET-FED ROTARY PRINTING PRESS WITH A PLURALITY OF PRINTING UNITS CONVERTIBLE FROM SINGLE-PAGE PRINTING TO FIRST FORM AND PERFECTOR PRINTING

[75] Inventor: Willi Becker, Bammental, Fed. Rep. of Germany

[73] Assignee: Heidelberger Druckmaschinen AG, Heidelberg, Fed. Rep. of Germany

[21] Appl. No.: 507,255

[22] Filed: Apr. 9, 1990

[30] Foreign Application Priority Data

Apr. 8, 1989 [DE] Fed. Rep. of Germany ..... 3911609

[51] Int. Cl.[5] ..... B41F 1/12; B41F 1/20; B41F 1/30

[52] U.S. Cl. ..... 101/183; 101/230

[58] Field of Search ..... 101/183, 230, 231, 232, 101/246, 409, 410, 411, 248; 271/225, 184, 186, 902; 74/439, 440, 444

[56] References Cited

U.S. PATENT DOCUMENTS 4,120,244 10/1978 Wirz ..... 101/409

4,147,105 3/1979 Becker ..... 101/230

4,782,717 11/1988 Becker ..... 74/439

*Primary Examiner*—J. Reed Fisher

*Attorney, Agent, or Firm*—Herbert L. Lerner; Laurence A. Greenberg

[57] ABSTRACT

Sheet-fed rotary printing press with a plurality of printing units convertible from single-page printing to first form and perfector printing and the reverse and a turning device disposed between two of the printing units, the turning device including a turning drum wherein a rotatable control shaft for effecting a gripper changeover is mounted, and a device for resetting the printing units including a gearwheel pair disposed in a chain of drive gearwheels and including a fixed gearwheel on the turning drum and, concentric therewith, an adjustable gearwheel adjustable in rotational angle, the fixed and adjustable gearwheels being clampable together, comprising means disposed on the adjustable gearwheel and actuable, within a predetermined angular range of relative movement between the adjustable gearwheel and the fixed gearwheel, on members for rotating the control shaft for effecting the gripper changeover.

22 Claims, 10 Drawing Sheets

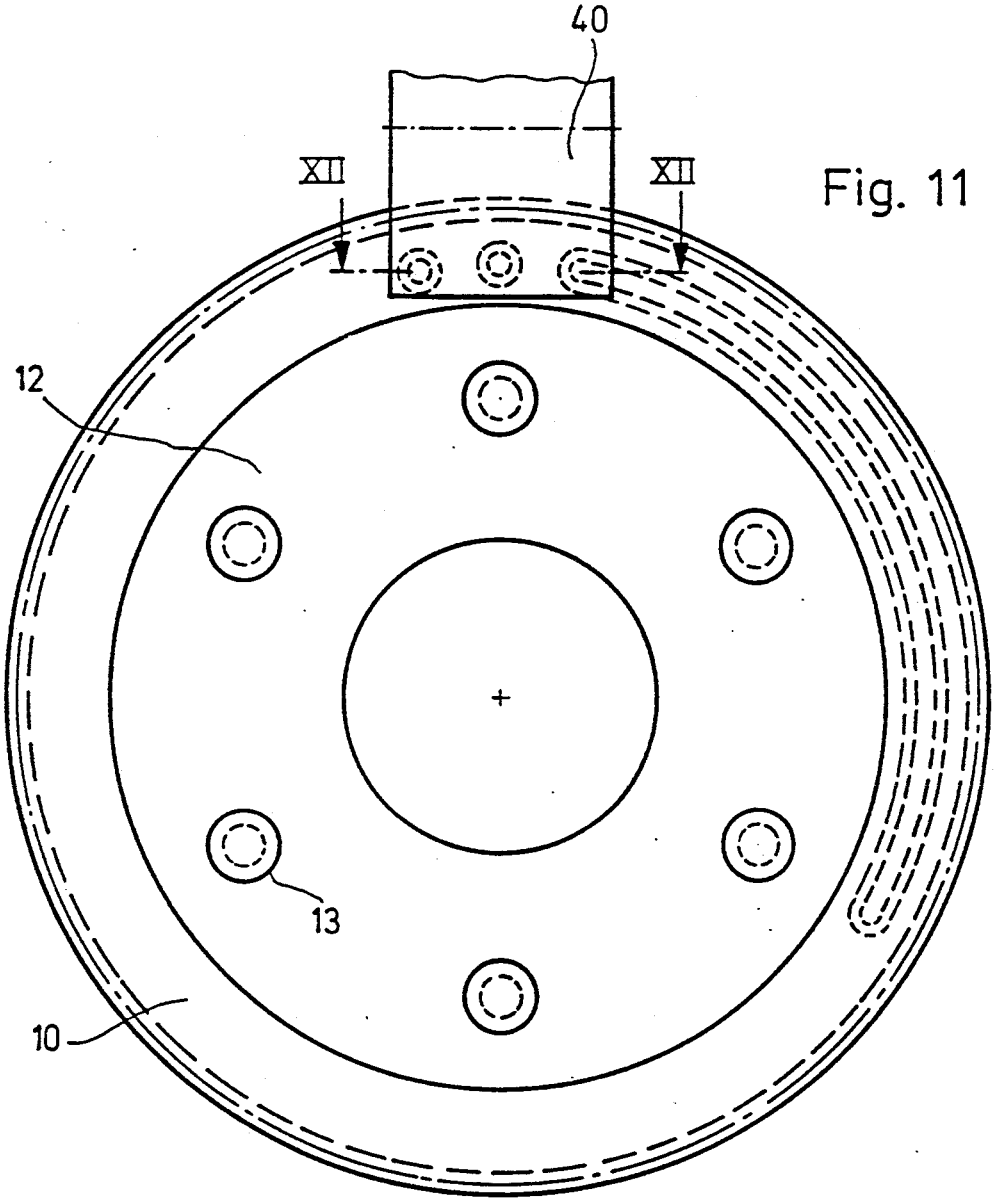
Fig. 11
Fig. 12
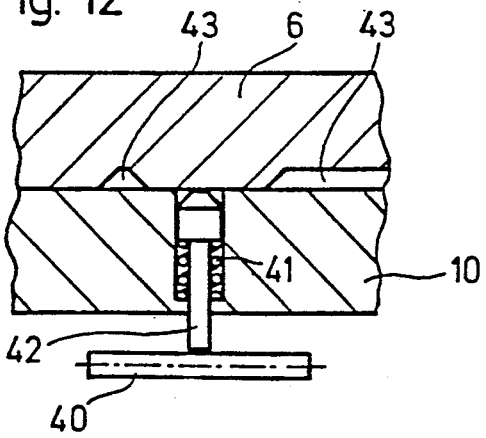
Fig. 13
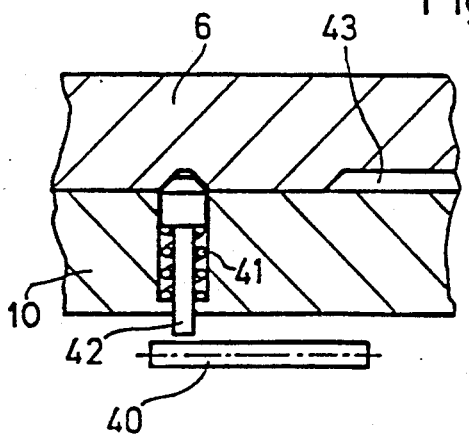

SHEET-FED ROTARY PRINTING PRESS WITH A PLURALITY OF PRINTING UNITS CONVERTIBLE FROM SINGLE-PAGE PRINTING TO FIRST FORM AND PERFECTOR PRINTING

The invention relates to a sheet-fed rotary printing press with a plurality of printing units convertible for printing either on one page of a sheet or on both pages of a sheet i.e. first form and perfector printing and, more particularly, to such a printing press having a turning device between two of the printing units, the turning device including a turning drum wherein a rotatable control shaft for effecting a gripper changeover is mounted, and a device for resetting the printing units, including a gearwheel pair disposed in a chain of drive gearwheels and including a fixed gearwheel on the turning drum and, concentric therewith, an adjustable gearwheel adjustable in rotational angle, the fixed and adjustable gearwheels being clampable together.

The state of the art with respect to this invention is represented by German Patent 26 20 392 and Japanese Patent 63-53037. During first form and perfector printing, a sheet which, for single-page printing, has been guided leading-edge first through the printing units, is guided in the turning device by its leading edge past a tangent point between a storage drum and a following turning drum and, the instant the trailing edge of the sheet has reached the tangent point, it is gripped by the turning grippers of the turning drum. Simultaneously, the leading edge of the sheet is released by the grippers of the storage drum, so that the sheet is then fed, trailing-edge first, to the next printing unit. To set up or convert the press from single-page (first-form) printing to first form and perfector printing, it is necessary to reset a whole series of individual functions. A resetting of the printing units to match or accommodate to the changed position of the sheet edge due to the turning of the sheet and, in a separate operation, a gripper changeover from leading-edge gripping to trailing-edge gripping of the sheet take place on the turning drum. Similarly, a changeover must take place if the printing press is to operate only in single page or first form printing mode.

In accordance with the aforementioned prior art, resetting of the printing units is effected by a gearwheel pair provided in a chain of drive gearwheels, which include a fixed gearwheel on the turning drum and an adjustable gearwheel concentric with the axis of the turning drum, the two gearwheels being lockable together by clamping so as to permit a stepless or infinite adjustment of the rotational angle between the printing units upstream of the turning device and the printing units downstream of the turning device in the travel direction of the sheets, an electrical safety system permitting operation of the printing press only if clamping has been properly performed.

According to the aforementioned German Patent 26 20 392, the gripper changeover is effected by an adjusting member or actuator which is axially displaceable in the turning drum and movable between two end positions by an eccentric turnable manually with a tool, one of the two end positions corresponding to the gripper position for single-page printing and the other to the gripper position for first form and perfector printing. No electrical safeguarding of the end positions occur normally. The changeover of the grippers requires an operator to climb onto the printing press as well as the removal and re-mounting of a cover in a separate operation.

Alternatively, Japanese Patent 63-53037 discloses a rotatable control shaft for the gripper changeover, the rotation of the control shaft effecting the gripper changeover. The control shaft extends concentrically out of the shaft of the turning drum at the drive side thereof, and is rotatable at that location by an attachable tool.

The gripper changeover is effected either by lifting-off the drive roller for the grippers of the gripper set for grasping the leading edge of the sheet from the drive cam which controls the gripper movement, and by lowering the drive roller for the grippers of the gripper set for grasping the trailing edge of the sheet onto a corresponding control cam and vice versa, respectively, or by shifting the drive roller from one drive cam to another.

It is accordingly an object of the invention to provide a sheet-fed rotary printing press with a plurality of printing units convertible from single-page printing to first form and perfector printing wherein the conversion or changeover operation at the turning device is simplified, accelerated and, above all, made more reliable.

With the foregoing and other objects in view, there is provided in accordance with the invention, a sheet-fed rotary printing press with a plurality of printing units convertible from single-page printing to first form and perfector printing and the reverse, and a turning device disposed between two of the printing units, the turning device including a turning drum wherein a rotatable control shaft for effecting a gripper changeover is mounted, and a device for resetting the printing units, including a gearwheel pair disposed in a chain of drive gearwheels and including a fixed gearwheel on , the turning drum and, concentric therewith, an adjustable gearwheel adjustable in rotational angle, the fixed and adjustable gearwheels being clampable together, comprising means disposed on the adjustable gearwheel and actuable, within a predetermined angular range of relative movement between the adjustable gearwheel and the fixed gearwheel, on members for rotating the control shaft for effecting the gripper changeover.

In accordance with another aspect of the invention, there is provided a sheet-fed rotary printing press with a plurality of printing units convertible from single-page printing to first form and perfector printing and the reverse, and a turning device disposed between two of the printing units, the turning device including a turning drum wherein adjusting members drivable from the outside are provided for changing-over a gripper control, and a device for resetting the printing units, a gearwheel pair disposed in a chain of drive gearwheels and including a fixed gearwheel on the turning drum and, concentric therewith, an adjustable gearwheel, adjustable in rotational angle, the fixed and adjustable gearwheels being clampable together, comprising means disposed on the adjustable gearwheel and actuable, within a predetermined angular range of relative movement between the adjustable gearwheel and the fixed gearwheel, on control elements for drives of the adjusting members drivable from the outside.

In accordance with another feature of the invention, wherein the means comprise a speed-transforming transmission having parts mounted on at least one of the gearwheels for converting the relative movement between the gearwheels, within a predetermined angular range, into a rotary movement, and transmitting the rotary movement to the control shaft for the gripper changeover.

A general purpose of the invention, therefore, is to combine the gripper changeover from turning-drum gripper controls for single-page printing to turning-drum gripper controls for first form and perfector printing with the resetting of the printing units which is necessary for a change or conversion of operating mode from single-page printing to first form and perfector printing and, simultaneously, to provide the requisite switching or control means. This dispenses with the need for a separate operation for the gripper changeover. At the same time, a considerable advantage is attained in that the gripper changeover falls under the electrical safety system for the resetting of the printing units. Setting-up times are consequently considerably reduced, servicing or operation of the printing press is simplified, and the safety and reliability of operation of the printing press is increased.

Basically, the gist of the invention may also be realized by providing means which are disposed on the adjustable gearwheel and preferably having the mechanical construction of a speed-transforming transmission, either in the form of a gear system or a lever mechanism, which effects the relative movements between the adjustable gearwheel and the fixed gearwheel within a defined range of rotational-angles on the control shaft for changing over the gripper control.

In accordance with a further feature of the invention, the means comprise a speed-transforming transmission having a toothed segment mounted on an end face of the turning drum so as to be swivellable about a journal axis aligned parallel to the axis of the turning drum, the journal axis being eccentric to the drum axis, the toothed segment having teeth meshing with a pinion disposed on the control shaft, and an entrainer link attached to the adjustable gearwheel and movable only within the predetermined angular range of relative movement of both gearwheels of the gearwheel pair and within a swivel range of an arm extending radially on the toothed segment.

In accordance with an added feature of the invention, the entrainer link attached to the adjustable gearwheel is in cooperative engagement with a control pin disposed on the arm of the toothed segment, the control pin, during a resetting phase starting from a machine setting for single page printing, being entrained by the entrainer link on an arc-shaped path for effecting the gripper changeover and being releasable by the entrainer link at a predetermined position and, during a resetting phase in the opposite direction, starting from a machine setting for first form and perfector printing, the control pin being entrainable by the entrainer link from the predetermined position and returnable to the original position thereof.

In accordance with an additional feature of the invention, the entrainer link cooperating with the control pin on the arm of the toothed segment is formed with defining side walls of different height.

In accordance with again another feature of the invention, the pinion on the control shaft and the toothed segment have teeth which are matched to a rotational angle of the control shaft necessary for effecting the gripper changeover.

In accordance with again a further feature of the invention, the entrainer link is attached to the adjustable gearwheel so as to be adjustable in the circumferential direction of the adjustable gearwheel.

Thus, mechanical realization of the invention is afforded by providing a toothed segment mounted at an end face of the turning drum, particularly at the end face of a turning-drum journal at the drive end of the drum, the toothed segment being swivellable about an axis parallel to the drum axis, the teeth of the toothed segment meshingly engaging with a pinion disposed on the control shaft, and the toothed segment being swivelled only within a predefined angular range by an entrainer link on the adjustable gearwheel. The adjustable gearwheel can then be rotated as desired beyond the angular range necessary for the gripper changeover in order to perform the further resetting of the printing units in accordance with sizes or formats of sheet being processed.

In accordance with again an added feature of the invention, the means comprise a lever mechanism including a lever attached to the control shaft mounted eccentrically in the turning drum, and a spring loading the lever in the changeover direction and tensioning the lever against a stop disposed on the adjustable gearwheel.

In accordance with again an additional feature of the invention, the spring is a tension spring connected at one end thereof with an end face of the turning drum and, at the other end thereof, with the lever, the spring drawing the lever against the stop on the adjustable gearwheel, and another stop is included which is fixed to the drum, the lever, after performing a predetermined swivel travel, being engageable with the other stop.

In accordance with yet another feature of the invention, the means comprise a lever mechanism formed by a toggle lever including hinge-connected straps, one end of the toggle lever being attached to the control shaft and the other end thereof being movably mounted on the adjustable gearwheel, the hinge-connected straps having lengths matched to a transmission ratio for transmitting to the control shaft, from an adjustment travel of the adjustable gearwheel relative to the fixed gearwheel during printing-unit resetting, a component of the movement necessary for the gripper changeover.

The latter constructions provide for the relative movement between the adjustable gearwheel and the fixed gearwheel within a predetermined angular range to be transmitted by means of a lever mechanism to the control shaft and converted by the latter into rotary movement.

In accordance with yet an added feature of the invention, an eccentric is connected via a miter gear unit to the control shaft, the eccentric being rotatable in the turning drum about a radial axis and, via an eccentric pin, engaging a bridge for changeover of the gripper control, the bridge being guided on the turning drum so as to be axially displaceable.

In accordance with yet an additional feature of the invention, a radially extending swivel lever is attached to an inner end of the control shaft, the swivel lever having a free end which, during a swivelling movement of the swivel lever, passes through a link guide, the link guide being formed with an axial offset corresponding to a displacement of an axially movable adjusting member, the link guide being provided in the adjusting member.

In accordance with still another feature of the invention, a roller engages in the link guide, the roller being disposed at the free end of the swivel lever.

The various preceding paragraphs define embodiments having advantageous features for the conversion of the rotary movement of the control shaft into axial movements of an actuator or adjusting member for the gripper changeover.

In accordance with still a further feature of the invention, the swivel lever is in a retracted position in the end positions of the gripper changeover.

In accordance with still an added feature of the invention, the means on the adjustable gearwheel comprise a control pin movably guided parallel to the axis of the gearwheels and being spring-biased against a fixed part of the turning drum, the control pin having a free outward-projecting end acting upon a control element for initiating a changeover operation.

In accordance with still an additional feature of the invention, only over a limited portion of the relative movement between the adjustable gearwheel and the fixed gearwheel, the control pin acts upon a control element for a servo-motor for the gripper changeover.

In accordance with another feature of the invention, the control pin is formed with a conical tip engaging in recesses formed on a fixed part of the turning drum for releasing the control element.

In accordance with a concomitant feature of the invention, the means comprise a switch situated in an electrical circuit of the drive of the printing press, the switch being actuable for interrupting the circuit outside of the end positions and forming part of an electrical safeguard for the printing press.

Thus, there is provided, in accordance with the invention, a combination of the features of the invention with electrical switching elements either for effecting the gripper changeover and/or for the electrical safeguarding of the turning device.

Other features which are considered as characteristic for the invention are set forth in the appended claims.

Although the invention is illustrated and described herein as embodied in a sheet-fed rotary printing press with a plurality of printing units convertible from single-page printing to first form and perfector printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 11 is a view like that of FIG. 2 of the embodiment shown in FIG. 10;

FIGS. 12 and 13 are cross-sectional views of FIG. 11 taken along the line XII—XII in the direction of the arrows during operating phases wherein gearwheels of a gearwheel pair are in different rotary positions.

Figure 1:
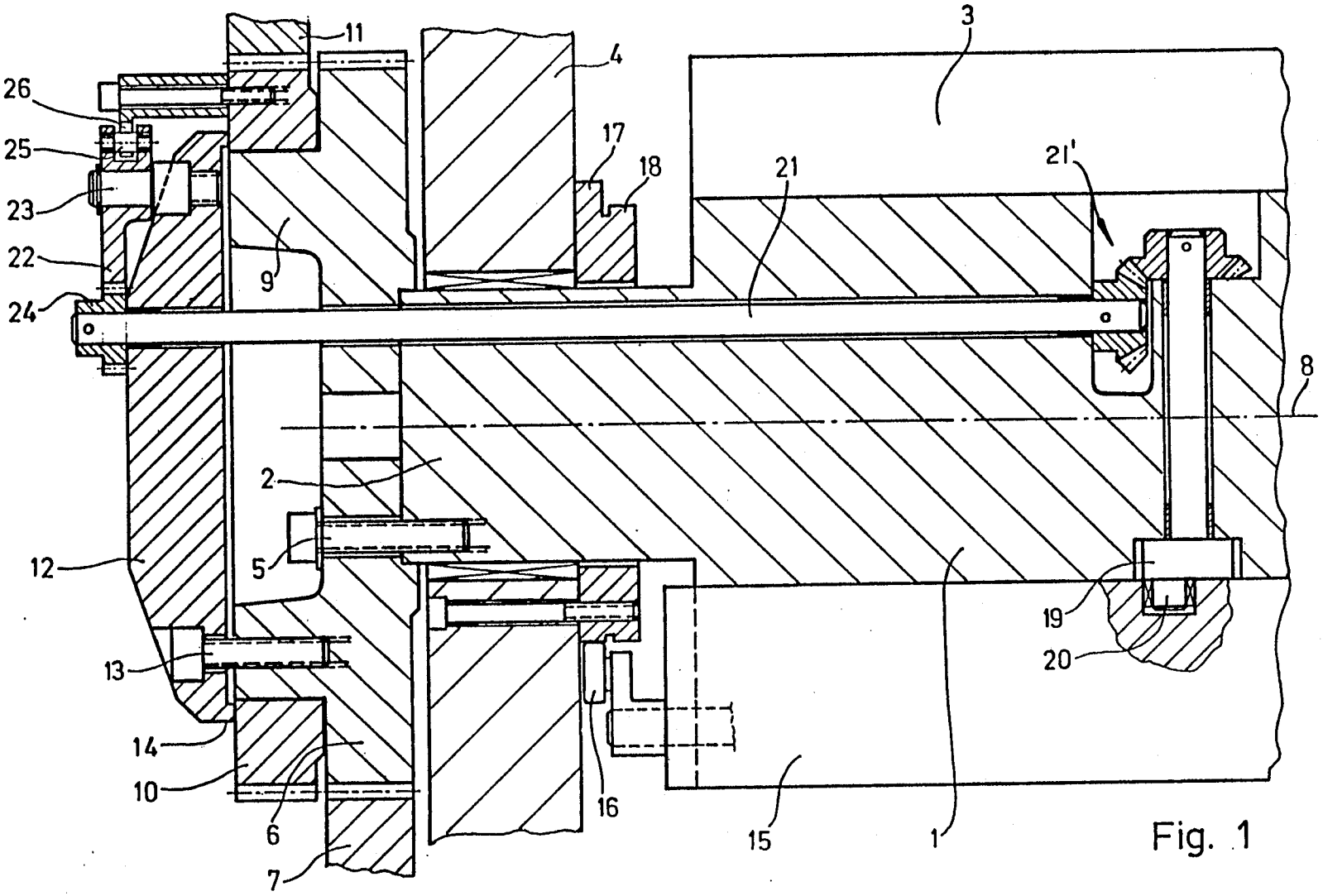
FIG. 1 is a fragmentary longitudinal sectional view, in an axial plane, of a turning drum according to the invention, showing an end thereof at which a drive therefor is located.

Referring now to the figures of the drawing, in various embodiments of the invention shown therein in order to explain the features of the invention, a turning drum 1 is rotatably supported in a frame 4 of a printing press by a drum journal 2 both at a non-illustrated operator end thereof and also at the illustrated drive end thereof. Grippers 50 (see FIG. 3, for example) are disposed in an outwardly open, axially parallel recess or channel 3 formed in the turning drum 1. Connected to an end face of the journal 2 by bolts 5 is a fixed gearwheel 6 having teeth by which it engages a gearwheel 7 of a drive chain of the gearwheels. Mounted on a shoulder 9 concentrically with the fixed gearwheel 6 and a longitudinal axis 8 of the turning drum 1 is an adjustable gearwheel 10, which is rigidly clampable to the fixed gearwheel 6, the gearwheel 10 having teeth which are in meshing engagement with a further gearwheel 11 in the drive chain of the gearwheels. The adjustable gearwheel 10 and the fixed gearwheel 6 are clamped, for example, by a clamping member 12, which can be bolted against the fixed gearwheel 6 by bolts 13 and is formed with a collar 14 by which it presses against an outer end face of the adjustable gearwheel 10. Because the clamping of the adjustable gearwheel 10 and the fixed gearwheel 6 to one another does not form any part of the invention, the foregoing serves merely to provide an example of the construction of such clamping.

The movement of the grippers, which are movably mounted in the recess 3, is controlled by a cam roller 16 through the intermediary of control levers and a bridge 15. For single page or first form printing, the cam roller 16 is in contact with a drive cam 17 attached to the frame 4 and, for first form and perfector printing, it is in contact with a drive cam 18 likewise attached to the frame 4. Through axial displacement of the bridge 15, it is possible for the cam roller 16 to be shifted from the drive cam 17 to the drive cam 18 and back. In the embodiment shown in FIGS. 1 and 2, an eccentric 19 is mounted in the turning-drum shaft 11 for effecting an axial displacement of the bridge 15, the eccentric 19 having an eccentric pin 20 which engages in a bearing on the bridge 15. The eccentric 19 is rotated by a control shaft 21 through the intermediary of a miter gear transmission unit 21', the control shaft 21 being rotatably mounted in the turning-drum shaft 1 eccentrically to the longitudinal axis 8 of the latter, and having an outwardly projecting free end passing through the fixed gearwheel 6 and the clamping member 12. The outwardly projecting free end of the control shaft 21 is connected to the adjustable gearwheel 10 by a speed-transforming transmission described hereinafter in greater detail with respect to the various embodiments, so that, when resetting a printing unit by varying the rotational angle of the adjustable gearwheel 10 with respect to the fixed gearwheel 6, a simultaneously changeover or shift of the gripper control occurs via the control shaft 21.

Figure 2:
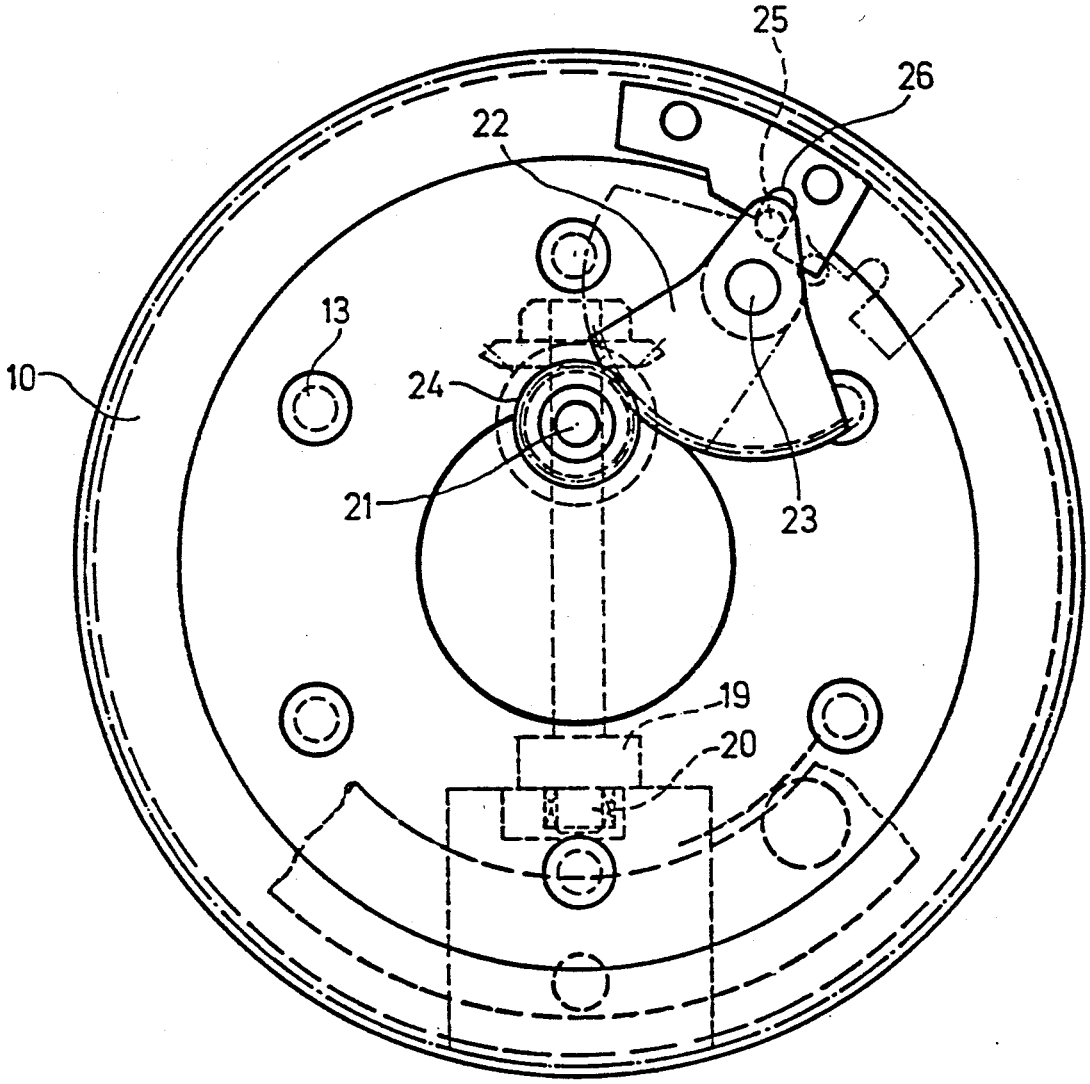
FIG. 2 is a left-hand end view of FIG. 1.

According to the embodiment of FIGS. 1 and 2, the speed-transforming transmission is formed of a toothed segment 22, which is mounted eccentrically to the longitudinal axis 8 on a part fixed to the drum, for example on the pressure member 12, the fixed gearwheel 6 or the like, in such a manner as to be swivellable about a pin 23 aligned parallel to the longitudinal axis 8, the toothed segment 22 being formed with teeth by which it meshes with teeth of a pinion 24 attached to the free end of the control shaft 21. The toothed segment 22 is formed as a double lever or bell-crank and, on an arm thereof located opposite the teeth thereof, carries a driving or entrainer pin 25 cooperating with an entrainer link 26, which is attached to the adjustable gearwheel 10 and is formed with a recess defined by walls of different height. The eccentric mounting of the control shaft 21 in the turning drum 1 ensures that, after a given rotational angle, the driving pin 25 is released from the recess of the driving link 26.

Because the driving pin 25 moves about the axis of the pin 23 when the toothed segment 22 swivels, the driving pin 25 approaches the longitudinal axis 8 on its path of movement, while the entrainer link 26 moves away, with the same spacing, from the longitudinal axis 8. At a given location, the lower defining wall of the recess of the entrainer link 26 releases the driving pin. On the return path, the longer defining wall of the recess ensures that the entrainer or driving pin 25 is returned to its original position. By a suitable selection of the gearwheel transmission ratio and of the spacing of the pitch circle of the toothed segment from the swivel axis of the pin 23 with respect to the distance of the driving or entrainer pin 25 from the same axis, assurance is provided that a safe and reliable gripper changeover or shift will occur when a printing-unit changeover or conversion occurs within a given angular range of the relative movement of the adjustable gearwheel 10 with respect to the fixed gearwheel 6. The entrainer link 26 attached to the adjustable gearwheel 10 may likewise be adjustable in the circumferential direction of the adjustable gearwheel 10. For this purpose, it is advantageous for the entrainer link 26 to be formed in a separate part bolted to the adjustable gearwheel 10. Because the parts of the speed-transforming transmission which transmits the relative movement between the adjustable gearwheel 10 and the fixed gearwheel 6 remain in a force-locking or non-positive friction-type engagement, it is possible, by way of electrically safeguarding the clamping between the adjustable gearwheel 10 and the fixed gearwheel 6, simultaneously to effect a safeguarding of the gripper changeover.

Figure 3:
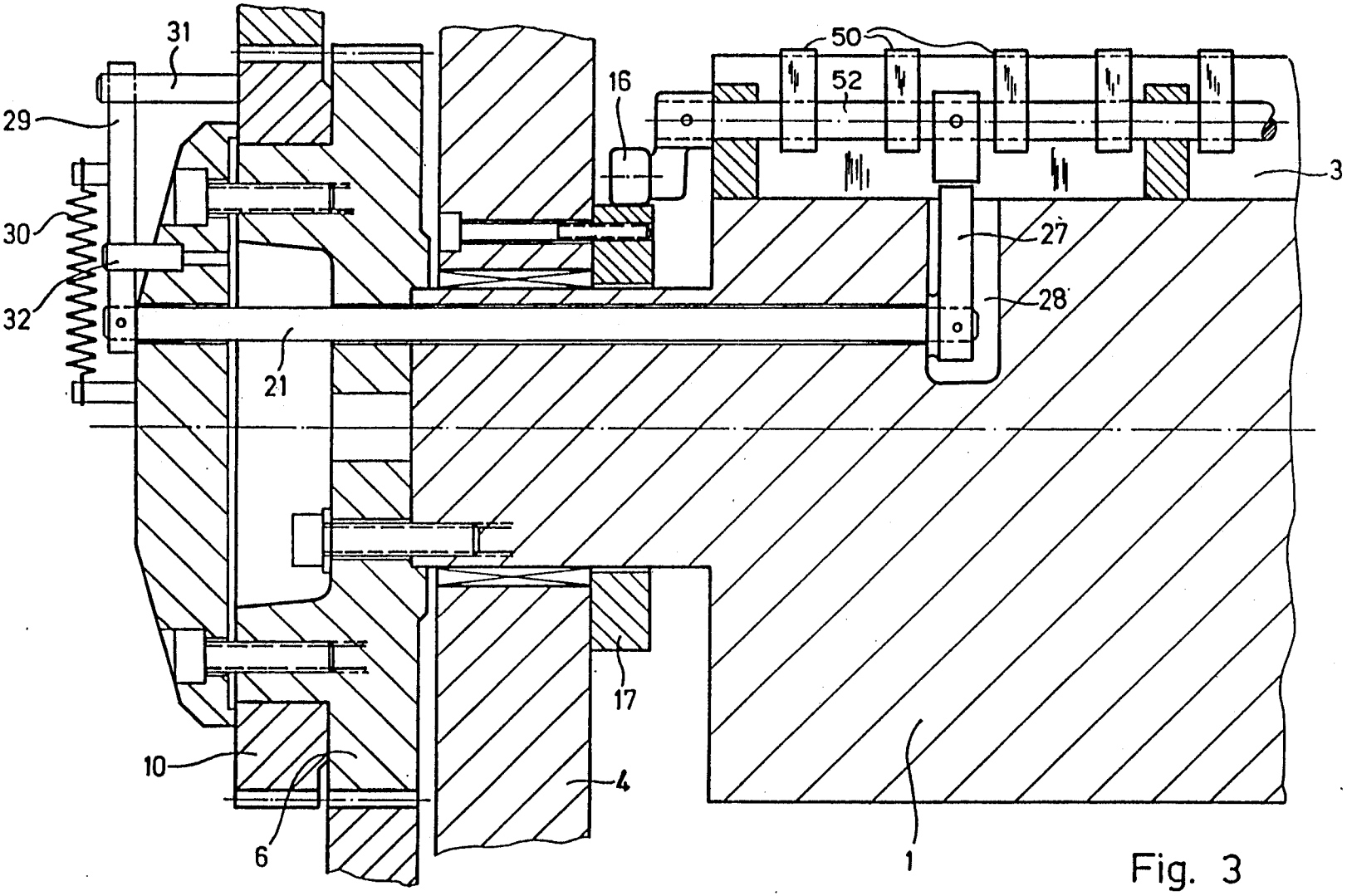
FIG. 3 is a view like that of FIG. 1 of a second embodiment of the invention.
Figure 4:
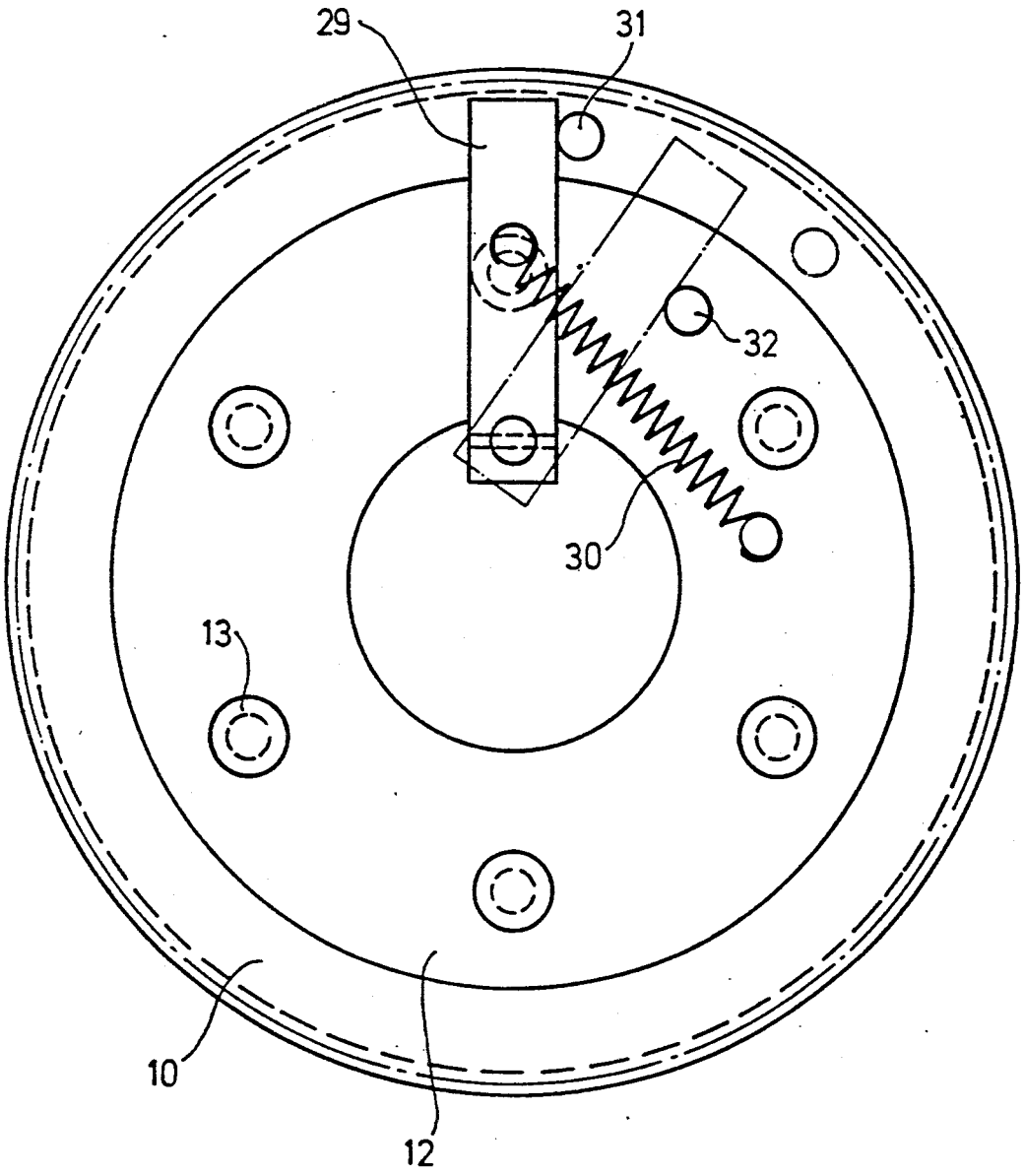
FIG. 4 is a view like that of FIG. 2 of the embodiment shown in FIG. 3.

In the embodiment shown in FIGS. 3 and 4, the gripper changeover is accomplished by stopping the cam roller 16, for example, by bringing it to a stop when the drive cam is at the top of a rise thereof or by lifting the cam roller 16 from the associated drive cam 17, so that a swivel movement is sufficient for the gripper changeover. The control shaft 21 is rigidly connected at an inner end thereof to a lever 27, which extends outwardly within a lateral recess 28 formed in the turning drum 1 and cooperates with a component on a gripper-bridge shaft 52 in such a manner that, in the position shown, it supports the gripper shaft 52 with the grippers 50 in a rest position thereof. Through a turning movement of the control shaft 21, the cam roller 16 is, for this purpose, lifted from the drive cam 17 and is locked in a crest or raised position, with the result that the grippers 50 remain in a rest position which does not impede the operation of the printing press. This also permits a simplification of the speed-transforming transmission for transmitting the relative movement of the adjustable gearwheel 10 with respect to the fixed gearwheel 6. Non-rotatably connected to the free end of the switching shaft 21 is a lever 29 which is preloaded by a spring 30 against a stop 31 on the adjustable gearwheel 10. Another stop 32 is fixed to the drum. During a resetting of the printing unit, the stop 31 moves with the adjustable gearwheel 10 relative to the fixed gearwheel 6 and other parts which are fixed to the drum 1. The tensioning force of the spring 30 overcomes the torque in the control shaft 21 necessary for the gripper changeover, and initially holds the lever 29 against the stop 31 until the lever 29 comes into contact with the stop 32. The gripper changeover occurs in the described manner on this first part of the travel. Upon further travel, a matching to sheet sizes or formats occurs, particularly to smaller sheet sizes or formats. During the resetting of the adjustable gearwheel 10, the lever 29 is returned from the stop 31 to its starting position. Instead of the tension spring 30 shown in the embodiment of FIGS. 3 and 4, which is anchored at one end thereof to a fixed part of the drum 1 and, with its other end, engages the lever 29, it is also possible to provide a compression spring or a different type of spring element.

Figure 5:
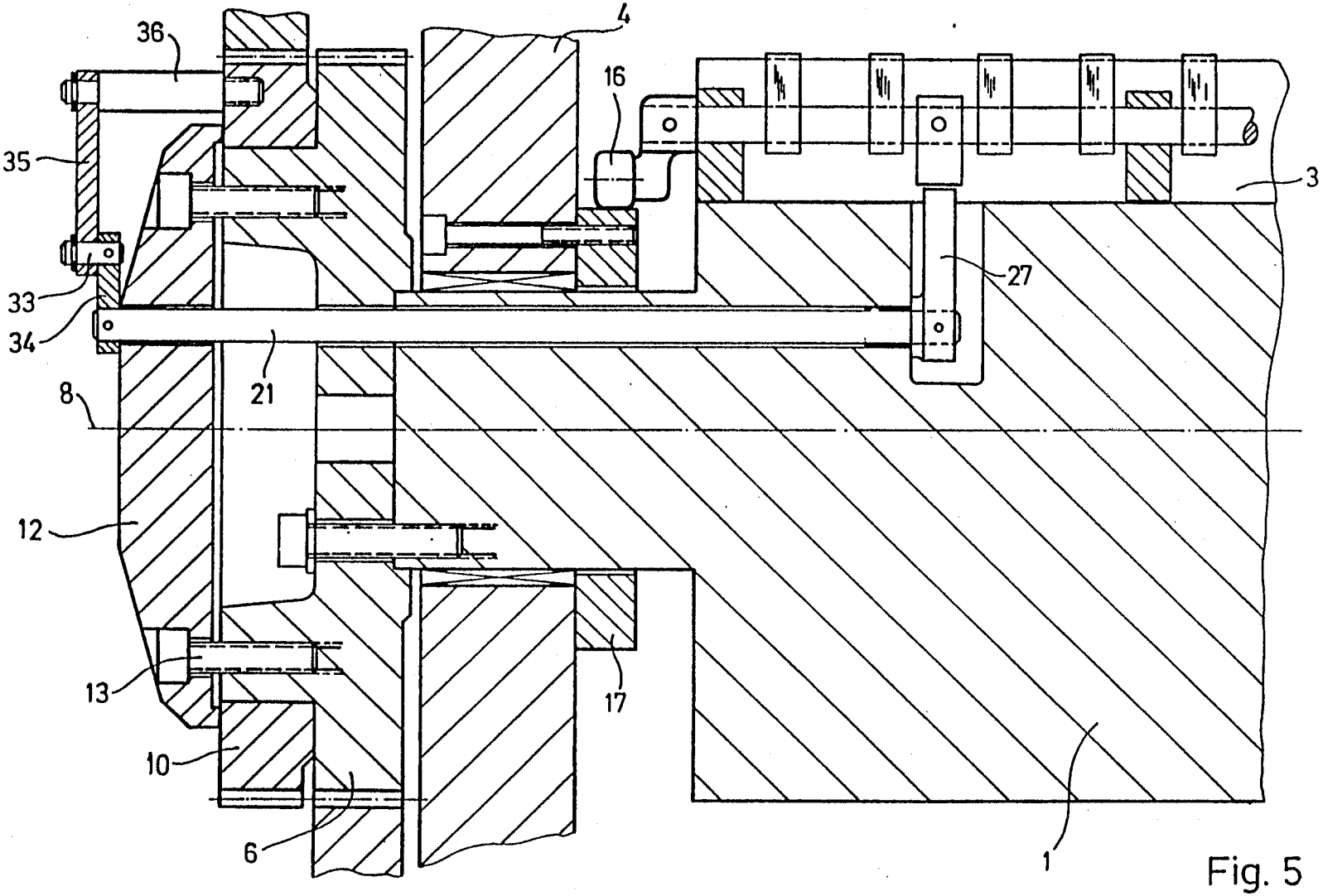
FIG. 5 is another view like that of FIG. 1 of a third embodiment of the invention.
Figure 6:
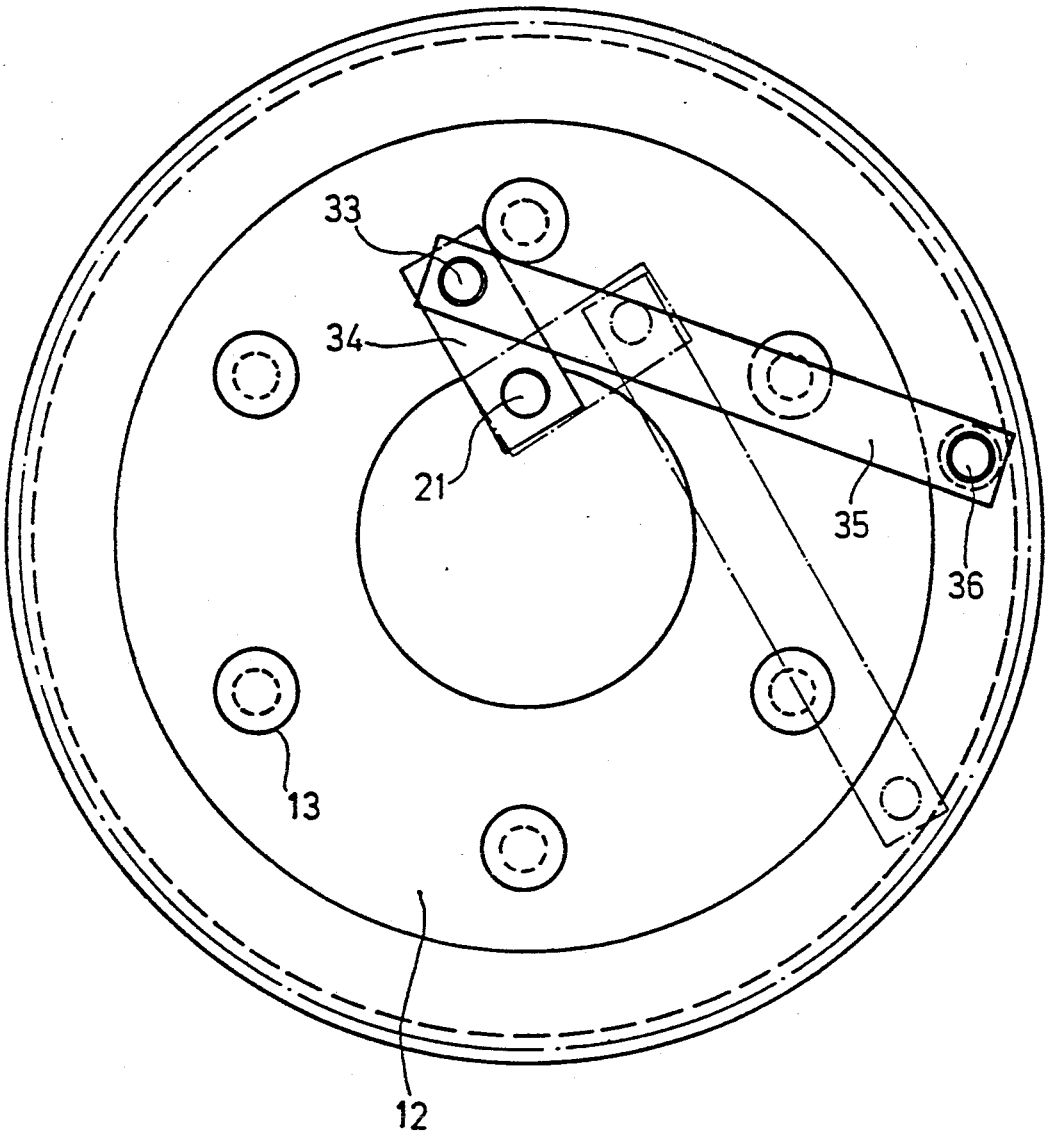
FIG. 6 is another view like that of FIG. 2 of the embodiment shown in FIG. 5.

In contrast with the embodiment in FIGS. 3 and 4, the embodiment of FIGS. 5 and 6 have, instead of a single rigid lever with stops, a lever mechanism formed of a hinged toggle lever made up of two straps 34 and 35 connected to one another at a swivel joint 33. The lever mechanism 33, 34, 35 is attached non-rotatably at one end to the control shaft 21 and rotatably at the other end to a bearing pin 36 on the adjustable gearwheel 10. In this embodiment, too, the relative movement of the adjustable gearwheel 10 with respect to fixed parts of the machine is accompanied by the transmission of a rotary movement to the control shaft 21, due to which the changeover of the gripper control is effected through the intermediary of the lever 27, so that the cam rolleer 16 is lifted from the drive cam 17. Preferably, such a construction can be used if the component of movement for the gripper changeover is not limited.

Figure 7:
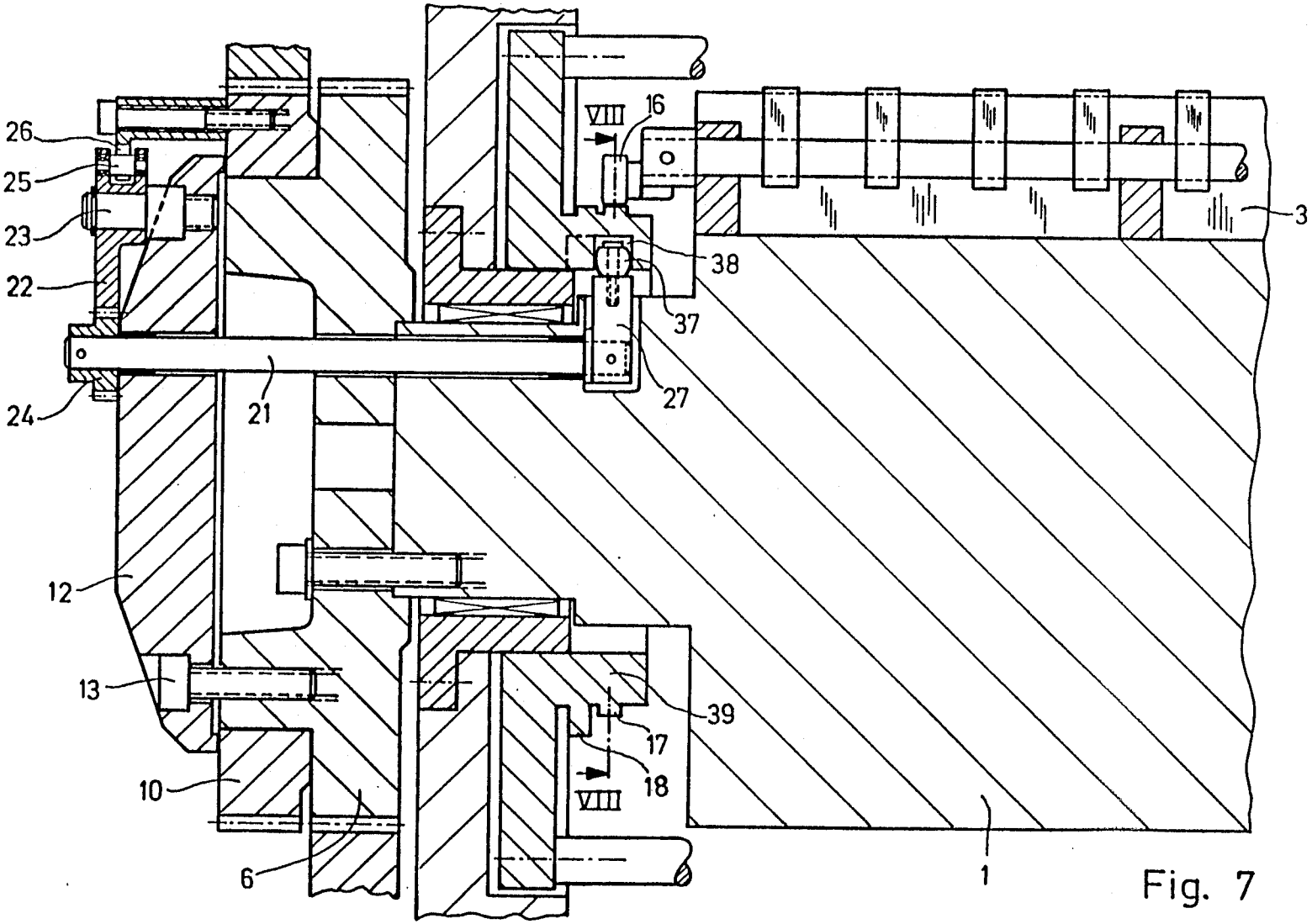
FIG. 7 is yet another view like that of FIG. 1 of a fourth embodiment of the invention which differs from the embodiment of FIG. 1 in the manner of converting rotation of a control shaft thereof into a linear axial movement.
Figure 8:
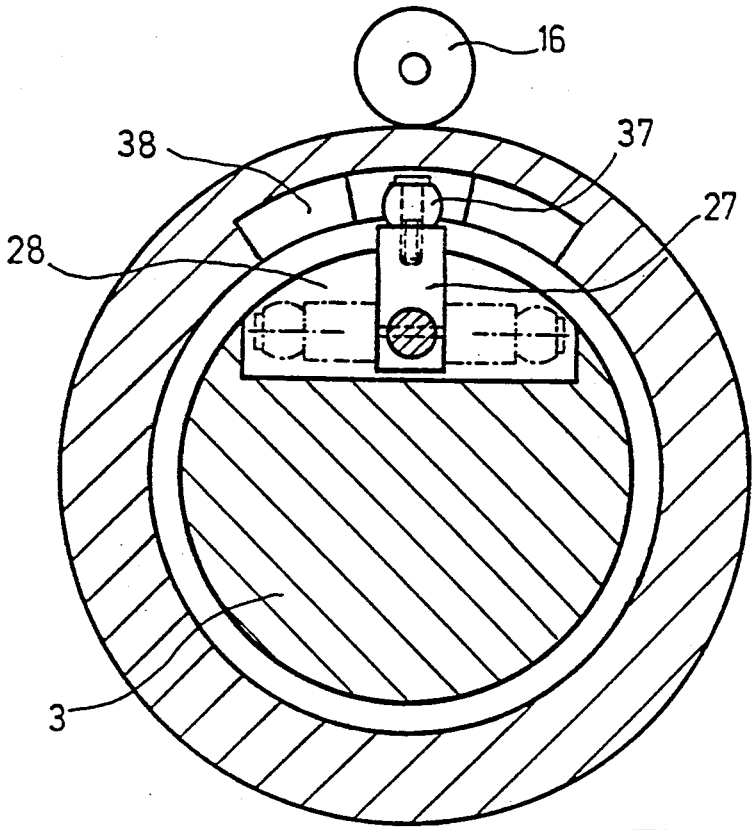
FIG. 8 is a cross-sectional view of FIG. 7 taken along the line VIII—VIII in the direction of the arrows.
Figure 9:
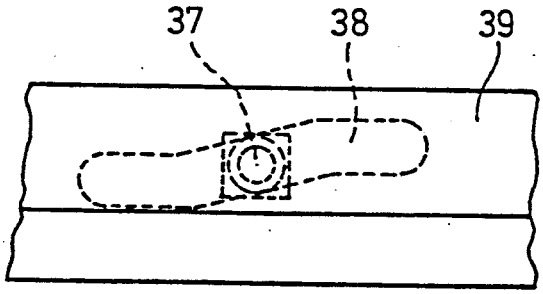
FIG. 9 is a fragmentary top plan view of FIG. 8.
Figure 10:
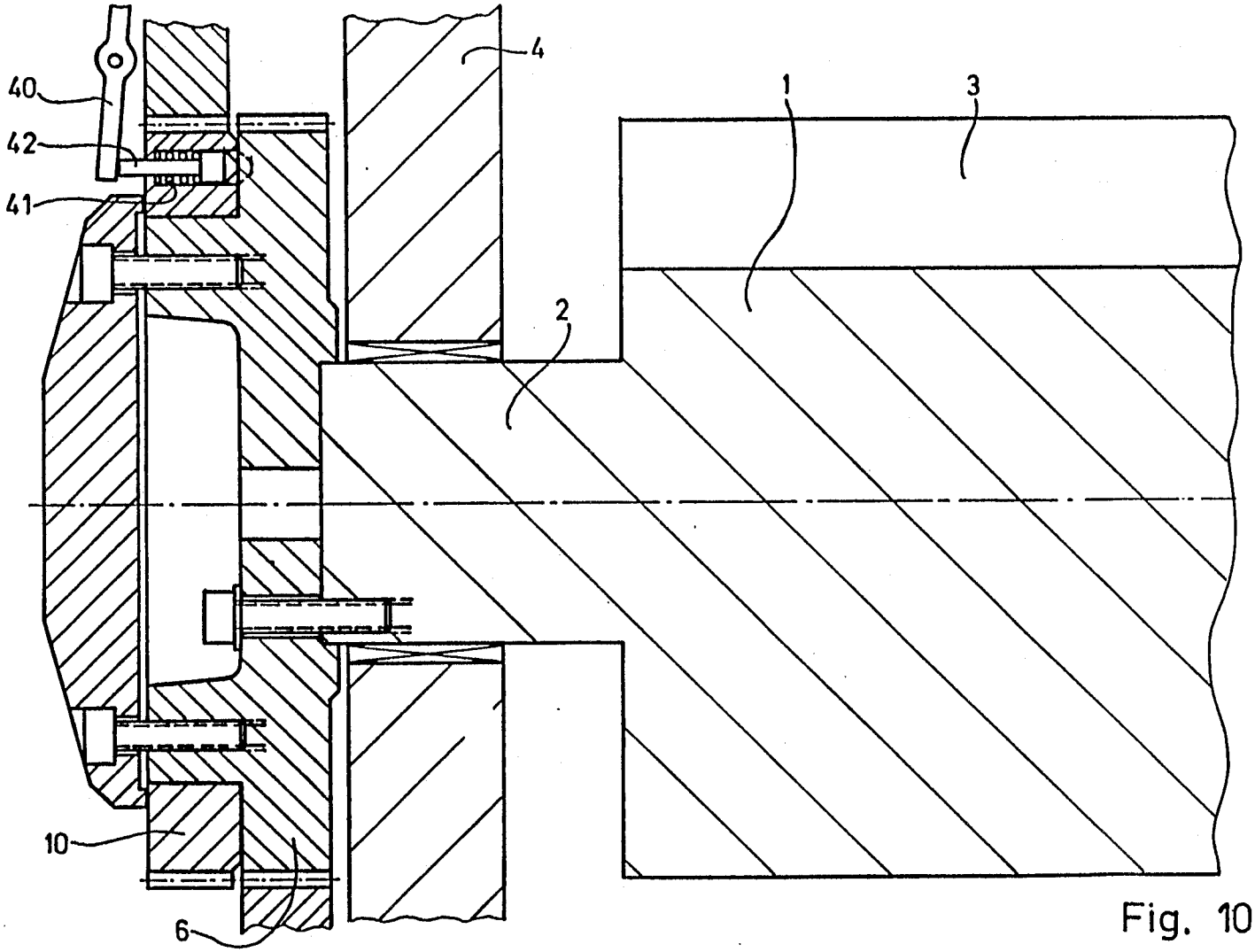
FIG. 10 is a view like that of FIG. 1 of a fifth embodiment of the invention having electrical switching elements.

In the embodiment of FIGS. 7, 8 and 9, the coupling of the resetting of the printing unit with the gripper changeover is effected basically by the same means as are described with respect to the embodiment of FIGS. 1 and 2. The control shaft 2!, however, acts upon a link control, through which, in contrast with the embodiments of FIGS. 1, 3 and 5, the cam roller 16 is not moved, but rather, the drive cams 17 and 18 are axially displaced, so that they likewise cooperate alternately with the cam roller 16. According to this embodiment of FIG. 7, the lever 27, described hereinbefor with reference to the embodiments shown in FIGS. 3 and 5, and connected at its inner end to the control shaft 21, is provided at its outer end with a head-piece 37, advantageously a rotatably mounted roller, which engages in a link guide 38 with axial offset. The link guide 38 is disposed in an axially displaceable component 39, on which the drive cams 17 and 18 are formed. The axial offset of the link guide 38 is believed to be readily apparent from the view of FIG. 9. Due to a swivelling movement of the head-piece 37 at the free end of the lever 27, which occurs in a radial plane, an axial displacement of the component 39 in accordance with the axial offset of the link guide 38 occurs. The speed-transforming transmission formed of the components 22 to 26 is constructed so that the lever 27 with the head-piece 37 executes a predetermined swivel movement (approximately 180 degrees in the illustrated embodiment of FIG. 7) and is thus located, in the end positions of the gripper changeover, in a retracted position within the recess 28 in the drum journal 2. For this purpose, the link guide 38 is provided with parts at the ends thereof which extend in a radial plane in order to permit the lever 27 with the head-piece 37 to dip out of and to dip back into the link guide 38 without any axial displacement of the component 39. An axial displacement occurs thus merely in vicinity of the oblique or inclined transition of the two parallel parts of the link guide 38, as is readily apparent from the view of FIG. 9.

Common to all of the aforementioned constructions is the advantage that a relatively thin control shaft 21 can be mounted in a hole of small diameter concentrically to the longitudinal axis 8, in the turning drum 1 and the journal 2, respectively, and that the laterally outward extension of the elements for transmitting the rotary or turning movement of the control shaft 21 to the elements for effecting the gripper changeover can be accomplished in recesses of relatively small dimensions, so that no weakening to effect the stability of the turning drum 1 or its journals 2 results.

FIGS. 10 to 13 show an embodiment of the invention in which electrical switching or control elements are used. A rocker arm 40 shown in FIG. 10 serves to actuate an electrical switch. The rocker arm 40 is moved by a control pin 42 which is, in turn, movably guided in the adjustable gearwheel 10 parallel to the longitudinal axis 8, and loaded or stressed against the fixed gearwheel 6 by a spring 41. In the end positions of the gripper changeover, the control pin 42 engages, by a conical tip thereof, in recesses 43 formed in the outer end face of the fixed gearwheel 6. The instant that an adjustment in the rotational angle of the adjustable gearwheel 10 occurs with respect to the fixed gearwheel 6, the control pin 42 is forced, due to the conical construction of the tip thereof, out of the recess 43, which is assigned to an end position, and is moved axially against the rocker arm 40. The latter can be used for switching on an electrical safety system and can also be disposed in the circuit of an electrical resetting device for the gripper changeover or other possibly desired or required changeovers or conversions. Because the rocker arm 40 is fixedly mounted, the time during which the adjusting servo-drive is on can be determined by a prescribed width of the rocker arm 40. After the gripper changeover, the control pin 42 can retract into a longer ring segment-shaped recess 43, so that the circuit is again interrupted. The rocker arm 40 may, however, also act upon control elements for hydraulically or pneumatically displaced actuators which perform necessary changeovers or conversions or initiate such changeovers.

The foregoing is a description corresponding in substance to German Application P 39 11 609.3, dated April 8, 1989, the International priority of which is being claimed for the instant application, and which is hereby made part of this application.

I claim:

1. Sheet-fed rotary printing press with a plurality of printing units convertible from single-page printing to first form and perfector printing and the reverse, a turning device disposed between two of the printing units for allowing resetting of the printing units between single-page printing and perfector printing, respectively, said turning device including a turning drum providing a gripper changeover for selectively gripping a leading-edge of a sheet for effecting single page printing and gripping a trailing-edge of a sheet for perfector printing, a turning drum having a rotatable control shaft, members for rotating said control shaft for effecting a gripper changeover, and a device for resetting the printing units, including a gearwheel pair disposed in a chain of drive gearwheels and including a fixed gearwheel on the turning drum and, concentric therewith, an adjustable gearwheel adjustable in rotational angle, the fixed and adjustable gearwheels being clampable together, comprising means disposed on the adjustable gearwheel and actuable, within a predetermined angular range of relative movement between the adjustable gearwheel and the fixed gearwheel, on members for rotating the control shaft for effecting the gripper changeover.

2. Sheet-fed rotary printing press with a plurality of printing units convertible from single-page printing to first form and perfector printing and the reverse, a turning device disposed between two of the printing units for allowing resetting of the printing units between single-page printing and perfector printing, respectively, said turning device including a turning drum providing a gripper changeover for selectively gripping a leading-edge of a sheet for effecting single page printing and gripping a trailing-edge of a sheet for perfector printing, a turning drum having adjustable members, control elements drivable form the outside of said turning drum for adjusting said members for effecting a gripper changeover, and a device for resetting the printing units, a gearwheel pair disposed in a chain of drive gearwheels and including a fixed gearwheel on the turning drum and, concentric therewith, an adjustable gearwheel, adjustable in rotational angle, the fixed and adjustable gearwheels being clampable together, comprising means disposed on the adjustable gearwheel and actuable, within a predetermined angular range of relative movement between the adjustable gearwheel and the fixed gearwheel, on said control elements for said adjusting members.

3. Sheet-fed rotary printing press according to claim 1, wherein said means comprise a speed-transforming transmission having parts mounted on at least one of the gearwheels for converting the relative movement between the gearwheels, within a predetermined angular range, into a rotary movement, and transmitting said rotary movement to the control shaft for the gripper changeover.

4. Sheet-fed rotary printing press according to claim 1, wherein said means comprise a speed-transforming transmission having a toothed segment mounted on an end face of the turning drum so as to be swivellable about a journal axis aligned parallel to the axis of the turning drum, said journal axis being eccentric to said drum axis, said toothed segment having teeth meshing with a pinion disposed on the control shaft, and an entrainer link attached to the adjustable gearwheel and movable only within the predetermined angular range of relative movement of both gearwheels of the gearwheel pair and within a swivel range of an arm extending radially on said toothed segment.

5. Sheet-fed rotary printing press according to claim 4, wherein said entrainer link attached to the adjustable gearwheel is in cooperative engagement with a control pin disposed on said arm of said toothed segment, said control pin, during a resetting phase starting from a machine setting for single page printing, being entrained by said entrainer link on an arc-shaped path for effecting the gripper changeover and being releasable by said entrainer link at a predetermined position and, during a resetting phase in the opposite direction, starting from a machine setting for first form and perfector printing, said control pin being entrainable by said entrainer link from said predetermined position and returnable to the original position thereof.

6. Sheet-fed rotary printing press according to claim 5, wherein said entrainer link cooperating with said control pin on said arm of said toothed segment is formed with defining side walls o different height.

7. Sheet-fed rotary printing press according to claim 5, wherein said pinion on the control shaft and said toothed segment have teeth which are matched to a rotational angle of the control shaft necessary for effecting the gripper changeover.

8. Sheet-fed rotary printing press according to claim 4, wherein said entrainer link is attached to the adjustable gearwheel so as to be adjustable in the circumferential direction of the adjustable gearwheel.

9. Sheet-fed rotary printing press according to claim 1, wherein said means comprise a lever mechanism including a lever attached to the control shaft mounted eccentrically in the turning drum, and a spring loading said lever in the changeover direction and tensioning said lever against a stop disposed on the adjustable gearwheel.

10. Sheet-fed rotary printing press according to claim 9, wherein said spring is a tension spring connected at one end thereof with an end face of the turning drum and, at the other end thereof, with said lever, said spring drawing said lever against said stop on the adjustable gearwheel, and including another stop fixed to the drum, said lever, after performing a predetermined swivel travel, being engageable with said other stop.

11. Sheet-fed rotary printing press according to claim 1, wherein said means comprise a lever mechanism formed by a toggle lever including hinge-connected straps, one end of said toggle lever being attached to the control shaft and the other end thereof being movably mounted on the adjustable gearwheel, said hinge-connected straps having lengths matched to a transmission ratio for transmitting to the control shaft, from an adjustment travel of the adjustable gearwheel relative to the fixed gearwheel during printing-unit resetting, a component of the movement necessary for the gripper changeover.

12. Sheet-fed rotary printing press according to claim 1, including an eccentric connected via a miter gear unit to the control shaft, said eccentric being rotatable in the turning drum about a radial axis and, via an eccentric pin, engaging a bridge for changeover of the gripper control, said bridge being guided on the turning drum so as to be axially displaceable.

13. Sheet-fed rotary printing press according to claim 1, including a radially extending swivel lever attached to an inner end of the control shaft, said swivel lever having a free end which, during a swivelling movement of said swivel lever, passes through a link guide, said link guide being formed with an axial offset corresponding to a displacement of an axially movable adjusting member, said link guide being provided in said adjusting member.

14. Sheet-fed rotary printing press according to claim 13, including a roller engaging in said link guide, said roller being disposed at said free end of said swivel lever.

15. Sheet-fed rotary printing press according to claim 13, wherein said swivel lever is in a retracted position in end positions of the gripper changeover.

16. Sheet-fed rotary printing press according to claim 1, wherein said means on the adjustable gearwheel comprise a control pin movably guided parallel to the axis of the gearwheels and being spring-biased against a fixed part of the turning drum, said control pin having a free outward-projecting end acting upon a control element for initiating a changeover operation.

17. Sheet-fed rotary printing press according to claim 16, including a servomotor for the gripper changeover and a control element for said servomotor, and wherein, only over a limited portion of the relative movement between the adjustable gearwheel and the fixed gearwheel, said control pin acts upon said control element for said servomotor for the gripper changeover.

18. Sheet-fed rotary printing press according to claim 17, wherein said control pin is formed with a conical tip engaging in recesses formed on a fixed part of the turning drum for releasing said control element.

19. Sheet-fed rotary printing press according to claim 2, wherein said means comprise a switch situated in an electrical circuit of a drive of the printing press, said switch being actuable for interrupting said circuit and forming part of an electrical safeguard for the printing press.

20. Sheet-fed rotary printing press according to claim 2, wherein said means comprise a lever mechanism including a lever attached to the control shaft mounted eccentrically in the turning drum, and a spring loading said lever in the changeover direction and tensioning said lever against a stop disposed on the adjustable gearwheel.

21. Sheet-fed rotary printing press according to claim 2, said turning drum having a rotatable control shaft, and wherein said means comprise a lever mechanism formed by a toggle lever including hinge-connected straps, one end of said toggle lever being attached to said control shaft and the other end thereof being movably mounted on the adjustable gearwheel, said hinge-connected straps having lengths matched to a transmission ratio for transmitting to the control shaft, from an adjustment travel of the adjustable gearwheel relative to the fixed gearwheel during printing-unit resetting, a component of the movement necessary for the gripper changeover.

22. Sheet-fed rotary printing press with a plurality of printing units convertible from single-page printing to first form and perfector printing and the reverse, a turning device disposed between two of the printing units for allowing resetting of the printing units between single-page printing and perfector printing, respectively, said turning device including a turning drum providing a gripper changeover for selectively gripping a leading-edge of a sheet for effecting single page printing and gripping a trailing-edge of a sheet for perfector printing, a turning drum having equipment for effecting a gripper changeover, and a device for resetting the printing units including, a gearwheel pair disposed in a chain of drive gearwheels and including a fixed gearwheel on the turning drum and, concentric therewith, an adjustable gearwheel, adjustable in rotational angle, the fixed and adjustable gearwheels being clampable together, comprising means disposed on the adjustable gearwheel and actuable, within a predetermined angular range of relative movement between the adjustable gearwheel and the fixed gearwheel, on the equipment for effecting the gripper changeover.

* * * * *